US008814732B2

(12) United States Patent
Jeanneau

(10) Patent No.: US 8,814,732 B2
(45) **Date of Patent: *Aug. 26, 2014**

(54) BLADE FOR A HOCKEY STICK

(71) Applicant: Sport Maska Inc., Montreal (CA)

(72) Inventor: Philippe Jeanneau, Lachine (CA)

(73) Assignee: Sport Maska Inc., Montreal, Quebec ( * ) Notice: Subject to any disclaimer, the term of this patent is extended or adjusted under 35 U.S.C. 154(b) by 0 days.

This patent is subject to a terminal disclaimer.

(21) Appl. No.: 14/072,273

(22) Filed: Nov. 5, 2013

(65) Prior Publication Data

US 2014/0057746 A1 Feb. 27, 2014

Related U.S. Application Data

(63) Continuation of application No. 13/072,287, filed on Mar. 25, 2011, now Pat. No. 8,602,923.

(51) Int. Cl.
*A63B 59/14* (2006.01)

(52) U.S. Cl.
USPC ..... 473/563

(58) Field of Classification Search
USPC ..... 473/560–563
See application file for complete search history.

(56) References Cited

U.S. PATENT DOCUMENTS

| | | | | |
|---|---|---|---|---|
| 4,148,482 | A | 4/1979 | Harwell et al. | |
| 5,160,135 | A | 11/1992 | Hasegawa | |
| 6,062,996 | A | 5/2000 | Quigley et al. | |
| 6,626,775 | B2 | 9/2003 | Tiitola | |
| 7,326,136 | B2 | 2/2008 | Jean et al. | |
| RE40,426 | E | 7/2008 | Gagnon et al. | |
| 8,602,923 | B2 * | 12/2013 | Jeanneau | 473/563 |
| 2003/0004019 | A1 | 1/2003 | Lussier et al. | |
| 2005/0070382 | A1 | 3/2005 | Loschiavo | |
| 2005/0090339 | A1 | 4/2005 | Gans et al. | |
| 2009/0149284 | A1 | 6/2009 | Garcia | |
| 2009/0280933 | A1 | 11/2009 | Gans | |
| 2011/0237365 | A1 | 9/2011 | McGrath et al. | |

FOREIGN PATENT DOCUMENTS

| | | |
|---|---|---|
| EP | 1316335 | 6/2003 |

* cited by examiner

*Primary Examiner* — Mark Graham
(74) *Attorney, Agent, or Firm* — Norton Rose Fulbright Canada

(57) ABSTRACT

A hockey stick blade comprising a front and a rear blade face, the front blade face comprising at least one front layer of reinforcing fiber material having a first reinforcing fiber density, and the rear blade face comprising at least one rear layer of reinforcing fiber material having a second reinforcing fiber density, the first reinforcing fiber density differing from the second reinforcing fiber density. A hockey stick having such a blade is also disclosed.

23 Claims, 11 Drawing Sheets

BLADE FOR A HOCKEY STICK

CROSS-REFERENCE TO RELATED APPLICATIONS

The present application is a continuation of U.S. application Ser. No. 13/072,287, which was filed on Mar. 25, 2011, the entire contents of which are incorporated by reference herein.

FIELD OF THE INVENTION

The present invention relates generally to blades for hockey sticks and to hockey sticks in general.

BACKGROUND

Hockey is a high paced, physically demanding sport that requires high levels of skill and endurance from the players. To stay on top of their game, hockey players are in need of reliable high performance equipment that enhances their game skills. As hockey sticks are used to pass the puck to other players and to shoot at the opposing team's net to score goals, they are considered as key pieces of equipment of any ice hockey players. The stick is often considered as an extension of the player's arm and any slight improvement in the stick's maneuverability, responsiveness and performance can have a significant impact on a player's game.

There are several different kinds of shots that a player can take with his stick including shovel shots, wrist shots, snap shots, slapshots, backhand shots and one timers. These different types of shots require the player to carry out different motions with his stick and players can take advantage of different characteristics of their sticks when performing many of these shots.

Today's conventional hockey sticks have a shaft and an adjoining blade. The shaft has a handle (being the portion that a typical player grasps during most of the course of normal use of the stick during game play) and a shank (being the portion extending below the handle to the connection point with the neck of the blade). The blade has a body having a striking surface and a neck extending upwards from the body that connects to the shank of the shaft.

The materials used to make hockey sticks have changed over the course of time. Hockey sticks have been made having shafts of solid wood, laminated wood, fiberglass-reinforced-polymer-coated wood, fiberglass-reinforced polymers, aluminum, or more recently, carbon-fiber-reinforced polymers. Similarly, hockey stick blades have been commonly made of different materials such as wood or carbon-fiber-reinforced polymers. Nowadays, hockey sticks are often one piece sticks having both a shaft and a blade made of a fiber-reinforced polymer, the shaft typically being hollow.

Two of the key characteristics of hockey sticks frequently referred to when it comes to improving a player's game are flexibility and the position of the kick point. The flexibility of an ice hockey stick refers to its capacity to bend when pressure is applied to it, such as while the player is performing the motion required for a particular shot and to get back to its initial shape. When it conies to flexibility, the stick is seen as a spring load capturing a portion of the energy generated by the player when performing his shooting motion, and releasing it toward the end of the player's motion to push to puck forward, thereby improving power and/or speed of the shot. The kick point is the portion of the ice hockey stick that flexes when pressure is applied to it. Some players prefer a hockey stick with a lower kick point. Further to past improvements in hockey stick design, a need has developed for hockey sticks providing always better performance allowing players to enhance their game.

SUMMARY

It is therefore an object of the present invention to provide for a blade for a hockey stick and fir is hockey stick.

Hockey sticks made with fiber-reinforced polymer have been traditionally made using layers of fiber reinforcement with a constant front face to back face fiber density. It is believed that prior to the present invention, makers of hockey sticks thought that using a constant fiber density may have contributed to symmetry of material properties and that such symmetry of material properties would give the best stick performance. The present inventors have recognized that a hockey stick as a whole has an unsymmetrical geometry and also recognized the impact on stick performance of using constant fiber density reinforcement. Contrary to the conventional wisdom, the present inventors have applied a varying fiber density to achieve a different balance of material properties and stick performance that can be better suited to some players.

It is another object of the present invention to provide a hockey stick blade comprising a front blade face, a rear blade face, a heel and a neck. The front blade face comprises at least one front layer of reinforcing fiber material, the at least one front layer having a first reinforcing fiber density. The rear blade face comprises at least one rear layer of reinforcing fiber material, the at least one rear layer having a second reinforcing fiber density, the first reinforcing fiber density differing from the second reinforcing fiber density.

In an additional aspect, the first reinforcing fiber density is greater than the second reinforcing fiber density. In another aspect, the second reinforcing fiber density is greater than the first reinforcing fiber density.

In a further aspect, the at least one front layer of reinforcing fiber material comprises reinforcing fibers being arranged in at least one front face reinforcing fiber pattern contributing to the first reinforcing fiber density; and the at least one rear layer of reinforcing fiber material comprises reinforcing fibers being arranged in at least one rear face reinforcing fiber material pattern contributing to the second reinforcing fiber density.

In an additional aspect, the at least one front face reinforcing fiber pattern comprises a plurality of front face fiber tows of reinforcing fibers, the plurality of front face fiber tows having a first tow width and being spaced apart from each other by a first distance. The at least one rear face reinforcing fiber material pattern comprises a plurality of rear face fiber tows of reinforcing fibers, the plurality of rear face fiber tows having a second tow width and being spaced apart from each other by a second distance. The first tow width and the first distance contribute to the first reinforcing fiber density, and the second tow width and the second distance contribute to the second reinforcing fiber density.

In a further aspect, the at least one front layer of reinforcing material comprises a plurality of front face fiber tows of reinforcing fibers having a first tow width. The at least one rear layer of reinforcing material comprises a plurality of rear face fiber tows of reinforcing fibers having a second tow width, the plurality of front face fiber tows having a different number of fibers per width than the plurality of rear face fiber tows.

In an additional aspect, the first reinforcing fiber density is greater than the second reinforcing fiber density.

In a further aspect, the plurality of front face fiber tows each contain about the same number of fibers as the plurality of rear face fiber tows, and the first tow width differs from the second tow width, the plurality of front face fiber tows having a different number of fibers per unit width than the plurality of rear face fiber tows.

In an additional aspect, the at least one front face reinforcing fiber pattern comprises a first front group of similarly aligned front face fiber tows of reinforcing fibers, the front face fiber tows of the first front group having a first tow width and being spaced apart from each other by a first distance, and a second front group of similarly aligned front face fiber tows of reinforcing fibers, the front face fiber tows of the second front group having a tow width similar to the first tow width, and being spaced apart from each other by a distance similar to the first distance. The first front group of similarly aligned front face fiber tows of reinforcing fibers extending at an angle relative to the front second group. The at least one rear face reinforcing fiber pattern also comprises a first rear group of similarly aligned rear face fiber tows of reinforcing fibers, the rear face fiber tows of the first rear group having a second tow width and being spaced apart from each other by a second distance, and a second rear group of similarly aligned rear face fiber tows of reinforcing fibers, the rear face fiber tows of the second rear group having a tow width similar to the second tow width, and being spaced apart from each other by a distance similar to the second distance. The first rear group of similarly aligned rear face fiber tows of reinforcing fibers extending at an angle relative to the second rear group.

In a further aspect, the front face fiber tows of the first front group extend generally parallel to each other, and the front face fiber tows of the second front group extend generally parallel to each other. The rear face fiber tows of the first rear group extend generally parallel to each other, and the rear face fiber tows of the second rear group extend generally parallel to each other.

In an additional aspect, the front face fiber tows of the first front group extend substantially perpendicularly to the front face fiber tows of the second front group, and the rear face fiber tows of the first rear group extend substantially perpendicularly to the rear face fiber tows of the second rear group.

In a further aspect, a portion of the front blade face covered by reinforcing fibers arranged in the at least one front reinforcing fiber pattern is approximately 1% to approximately 10% greater than a portion of the rear blade face covered by reinforcing fibers arranged in the at least one rear reinforcing fiber pattern.

In an additional aspect, a ratio of the first tow width to the second tow width is approximately 0.2 to approximately 0.8.

In a further aspect, a ratio of the first distance to the second distance is approximately 0.2 to approximately 0.8.

In an additional aspect, an area of the front blade face covered by the first and second front groups is a first covered area, an area of the rear blade face covered by the first and second rear groups is a second covered area, and a ratio of the first covered area to the second covered area is approximately 0.8 to approximately 1.1.

In a further aspect, the blade is integral with a hockey stick shaft.

In an additional aspect, the at least one front face reinforcing fiber pattern consists of a plurality of distinct front face fiber tows and the least one rear face reinforcing fiber material pattern consists of a plurality of distinct rear face fiber tows. The plurality of distinct front face fiber tows is greater in number than the plurality of distinct rear face fiber tows.

In a further aspect, each tow of the plurality of distinct front face fiber tows has about the same number of reinforcing fibers as each tow of the plurality of distinct rear face fiber tows.

In an additional aspect, the reinforcing fiber material comprises carbon fibers.

In a further aspect, the reinforcing fiber material is a carbon-fiber-reinforced polymer.

It is also another object of to present invention to provide a hockey stick comprising a shaft having a proximal end and a distal end opposite the proximal end, a front face and a rear face, and a blade connected to the shaft. The blade has a front blade face, a rear blade face, a heel and a neck adjacent the proximal end of the shaft. The front blade face comprises at least one front layer of reinforcing fiber material, the at least one front layer having a first reinforcing fiber density. The rear blade face comprises at least one rear layer of reinforcing fiber material, the at least one rear layer having a second reinforcing fiber density. The first reinforcing fiber density differs from the second reinforcing fiber density.

In an additional aspect, the hockey stick is a one piece hockey stick.

In a further aspect, the at least one front layer of reinforcing fiber material extends along at least a portion of the front face of the proximal end of the shaft, and the at least one rear layer of reinforcing fiber material extends along at least a portion of the rear face of the proximal end of the shaft.

In an additional aspect, the at least one front layer of reinforcing fiber material extends along the front face of the shaft, and the at least one rear layer of reinforcing fiber material extends along the rear face of the shaft.

In a further aspect, the first reinforcing fiber density is greater than the second reinforcing fiber density.

In an additional aspect, the at least one front layer reinforcing material comprises a plurality of front face fiber tows of reinforcing fibers having a first tow width, the at least one rear layer of reinforcing material comprises a plurality of rear face fiber tows of reinforcing fibers having a second tow width, the plurality of front face fiber tows having a different number of fibers per unit width than the plurality of rear face fiber tows.

In a further aspect, the first reinforcing fiber density is greater than the second reinforcing fiber density.

For purposes of this application, terms used to locate elements on a blade for a hockey stick or an entire hockey stick, or their spatial orientation, such as "forwardly", "rearwardly", "front", "back", "rear", "left", "right", "up", "down", "above", and "below", are as they would normally be understood by a person using a hockey stick normally.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 10:
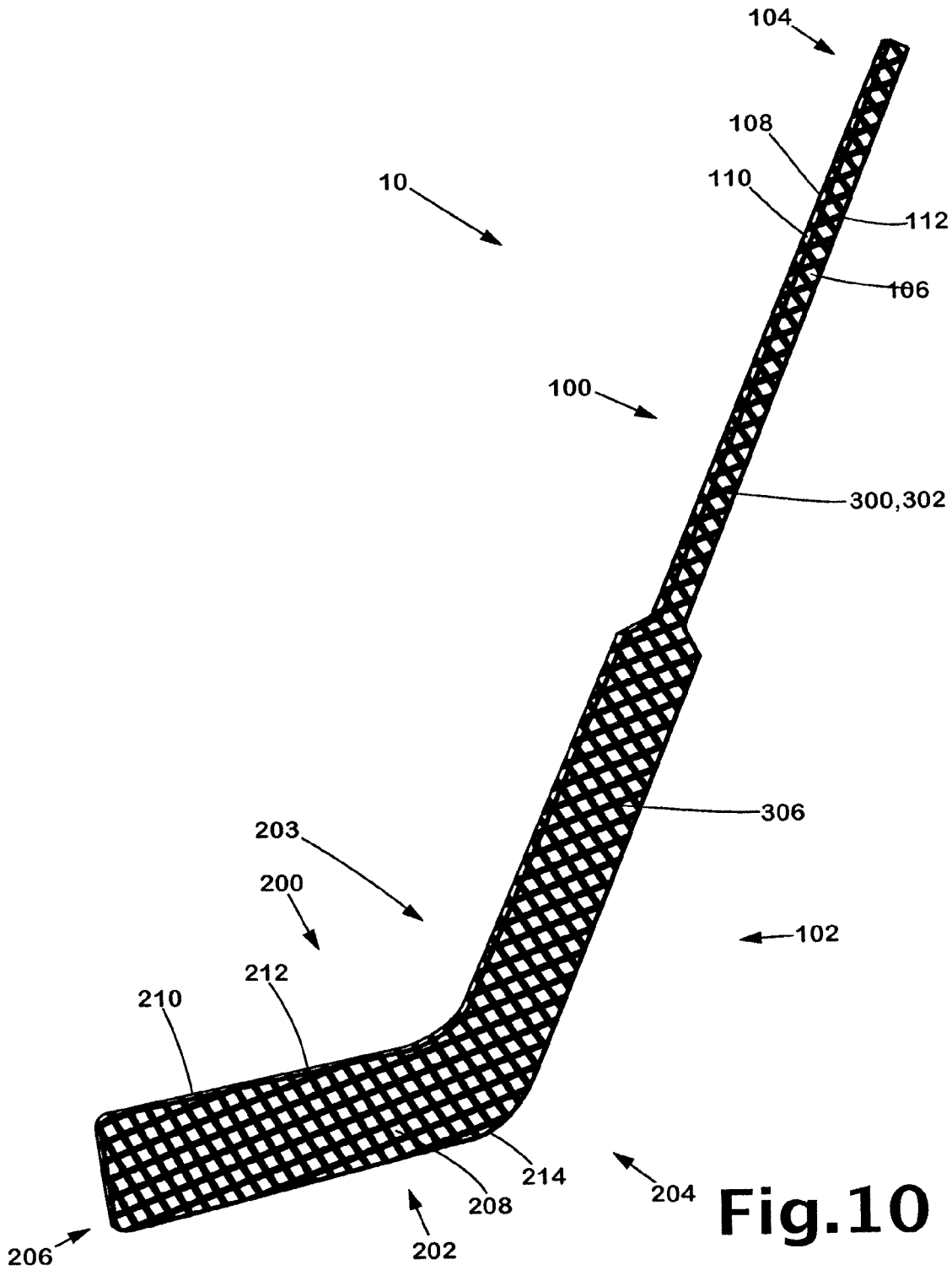
FIG. 10 is a perspective view, taken from a front, top, left side of a goalie hockey stick according to another embodiment.

The preferred embodiments described therein are discussed with respect to a hockey stick 10. However, it is contemplated that other embodiments include other types of sports equipment, such as the goalie stick shown in FIG. 10, field hockey sticks, lacrosse sticks, or baseball and softball bats. It is also to be noted that while various embodiments are discussed therein as examples, they are not intended to be limiting on the scope of the invention claimed and proposed variations on the described embodiments are not intended to be an exhaustive lists of such possible variations.

Figure 1:
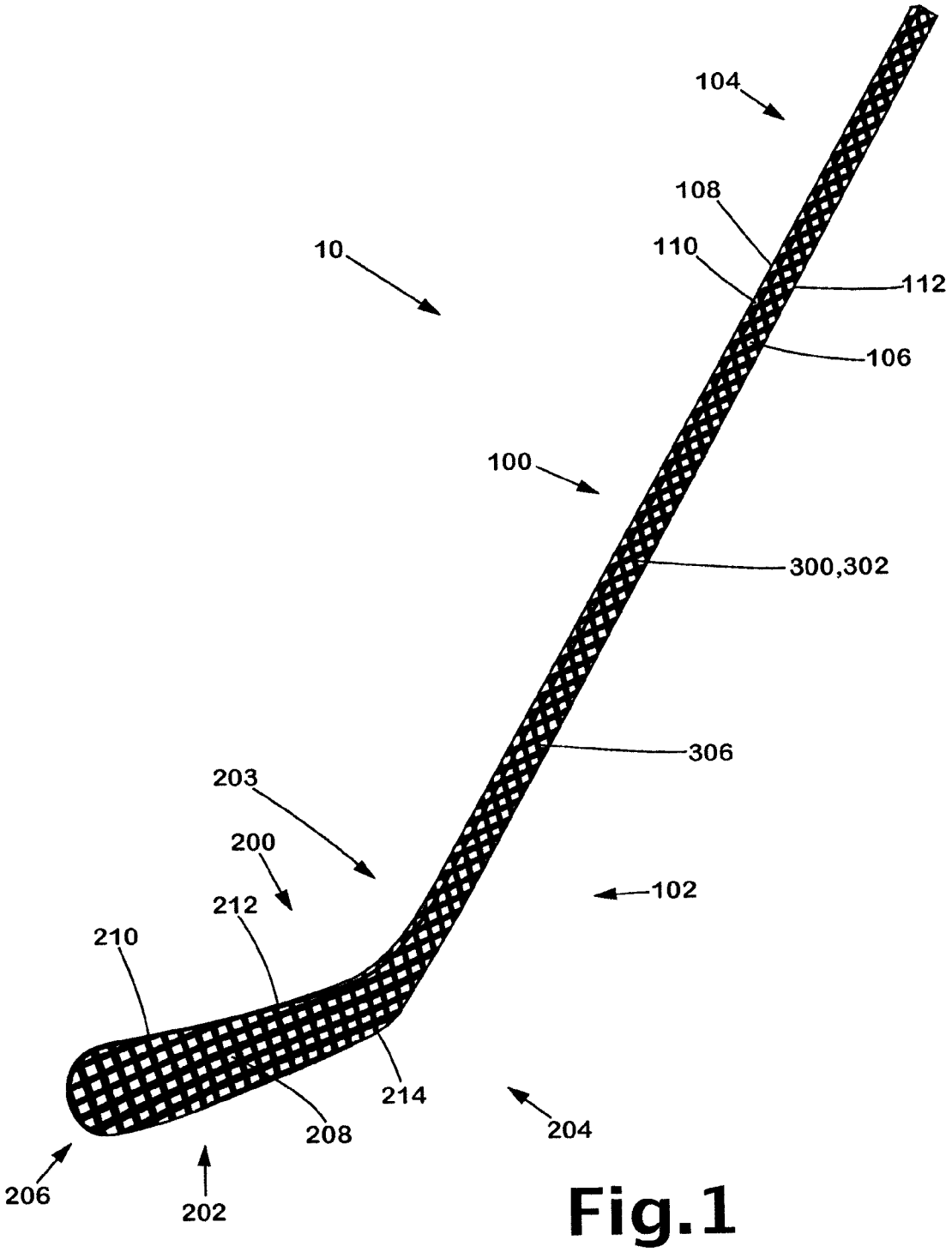
FIG. 1 is a perspective view, taken from a front, top, right side of a hockey stick according to a first embodiment.

As shown in FIG. 1, a hockey stick 10 is provided. The stick 10 has a shaft 100 and a blade 200. The stick 10 shown in the figures is a right-handed stick. A left-handed stick, which would be a mirror image of the stick 10 shown in the figures, is also contemplated.

The shaft 100 has a proximal end 102 proximate the blade 200, and a distal end 104 opposite the proximal end 106. As better shown in FIGS. 2 and 3, the shaft 100 has a generally rectangular cross-section and has a front face 106, a rear face 108 opposite the front face 106, a top side face 110 and a bottom side face 112 opposite the top side face 110.

The blade 200 has a main blade body 202, a neck 203, a heel 204 and toe 206. As better shown in FIGS. 4 and 5, the blade 200 has a generally rectangular cross-section (although more flat in comparison with the shaft 100) and has a front face 208, a rear face 210 opposite the front face 208, a top side face 212 and a bottom side face 214 opposite the top side face 212.

The front face 106 of the shaft 100 and the front face 206 of the blade 200 generally extend on a same plane and in this embodiment, one can be considered as the continuation of the other. This is also the case for the rear faces 108 and 210, top side faces 110 and 212, and bottom side faces 112 and 214.

As shown in FIGS. 1 to 5, a portion of the proximal end 102 of the shaft 100 and a portion of the neck 203 and heel 204 of the blade 200 are tapered. More particularly, portions of the proximal end 102 of the shaft 100 and neck 203 and heel 204 gradually taper from the generally rectangular shape of the shaft 102 to the flatter main blade body 202. Such tapered portions of the proximal end 102 of the shaft 100 and neck 203 and heel 204 of the blade 200 provide a gradual transition from the shaft 100 to the blade 200.

In this embodiment, the stick 10 is a one piece stick having a blade 200 integrally formed with the shaft 100. However, it is contemplated that in other embodiments, the blade 200 and shaft 100 can be manufactured and/or provided to customers as different parts permanently or releasably connected to each other via any suitable fastener(s) and/or connecting mean(s) including but not limited to bolt and nut assembly(ies) and glue.

In this embodiment, the stick 10 is made of superposed layers of carbon fiber reinforced fabric in an epoxy resin matrix. In different embodiments, the various superposed layers of fiber reinforced material can include carbon fiber, glass fiber, para-aramid synthetic fiber, polypropylene fiber, boron fiber, or a combination thereof. Such layers of fiber reinforced material can include woven or nonwoven layers of fibers or combinations thereof. It is contemplated that in various embodiments, the fibers can be in the form of continuous fibers or discontinuous fibers and can be aligned, patterned, or randomly oriented. In some embodiments, the fiber reinforced material can include a thermoset or thermoplastic resin matrix. The fiber reinforced material can include different types of resins, such as, for example, a two-part epoxy resin, a polyester resin, a urethane resin, or a combination thereof. In this embodiment, the blade 200 comprises a core of foam, such as polyurethane foam (not shown). However, it is contemplated that in other embodiments, the blade 200 can be solely made of layers of carbon fiber reinforced fabric or other fiber reinforced fiber material or can have another, non-foam core such as, for example, a wood core.

The stick 10 also comprises at least one layer of carbon fiber reinforced material 300 comprising a first sheet of carbon fiber reinforced fabric 302 and a second sheet of carbon fiber reinforced fabric 304. As better shown in FIGS. 6 to 9, each sheet of carbon fiber reinforced fabric 302, 304 is made of fiber tows 306 of fibers 308 (schematically represented by visible lines in FIGS. 2 to 9) embedded in an epoxy resin. Again, it is contemplated that in other embodiments, other types of reinforcing fibers can be used, such as, for example, glass fibers or para-aramid synthetic fibers, or a combination thereof, and different types of thermoplastic or thermoset resins can be used, such as, for example, a two-part epoxy resin, a polyester resin, a urethane resin, or a combination thereof in some embodiments, a resin pre-impregnated reinforced fabric is used. In other embodiments, the composite could be formed using, for example, resin transfer molding, infusion molding, injection molding, wet lay-up, or any other technique known in the composite art.

Each fiber tow 306 comprises a plurality of fibers 308 generally extending in the same direction as the fiber tow 306 they are part of. Each fiber tow 306 comprises a number of fibers 308 ranging from approximately 3,000 to approximately 12,000 fibers 308. However, it is contemplated that in other embodiments, each fiber tow 306 can comprise between approximately 1,000 to approximately 25,000 fibers 308. Generally, the fibers 308 extend the length of the fiber tow 306 that they are a part of, but in some instances one or more individual fibers 308 may not extend the entire length of the fiber tow 304 due to, for example, cuts, breaks, or fractures of the individual fibers. In the embodiments shown in the figures, the fiber tows 306 each comprise almost the same number of fibers 308. It is contemplated that in other embodiments, different fiber tows 304 may comprise different number of fibers 308.

In some embodiments, each fiber tow 306 has a tensile strength ranging from approximately 3,500 Megapascal (MPa) to approximately 6,500 MPa and a tensile modulus ranging from approximately 150 Gigapascal (GPa) to approximately 300 GPa. In certain embodiments, each fiber tow 306 has a tensile strength ranging from approximately 4,500 Megapascal (MPa) to approximately 5,500 MPa and a tensile modulus ranging from approximately 200 Gigapascal (GPa) to approximately 250 GPa.

As shown in FIGS. 6 to 9, each sheet of carbon fiber reinforced fabric 302, 304 comprises a first group 310 of fiber tows 306 of fibers 308 extending generally parallel to each other and a second group 312 of fiber tows 306 of fibers 308 extending generally parallel to each other and perpendicularly to the first group of fiber tows 310. It is also contemplated that in other embodiments, one of the first group 310 and second group 312 of fibers 308 could be replaced by any other suitable reinforcing fibers, such as glass fibers or para-aramid synthetic fibers, or a combination thereof.

Figure 2A:
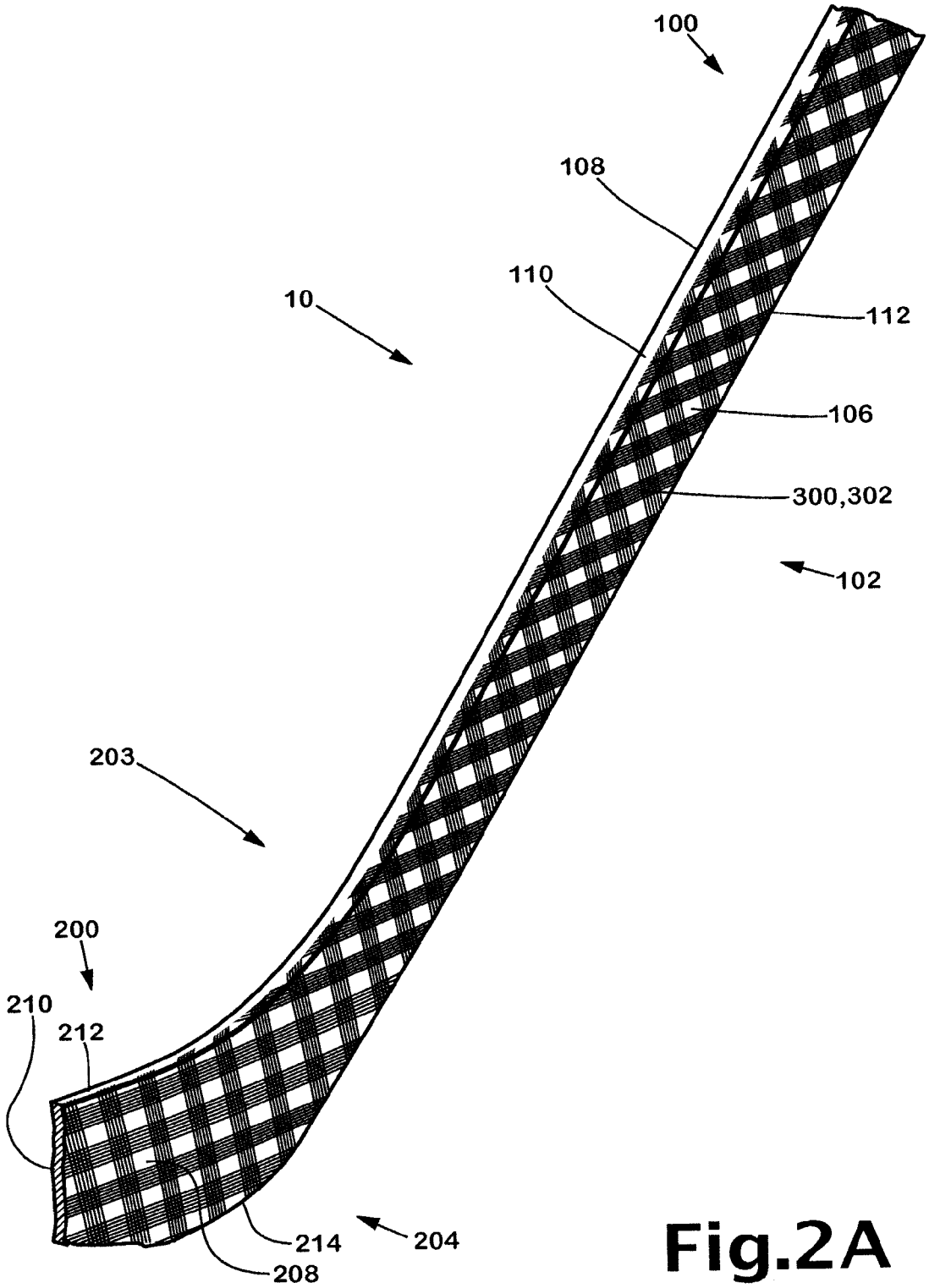
FIG. 2A is a perspective view, taken from a front, top, right side of an enlarged portion of the hockey stick of FIG. 1.
Figure 2B:
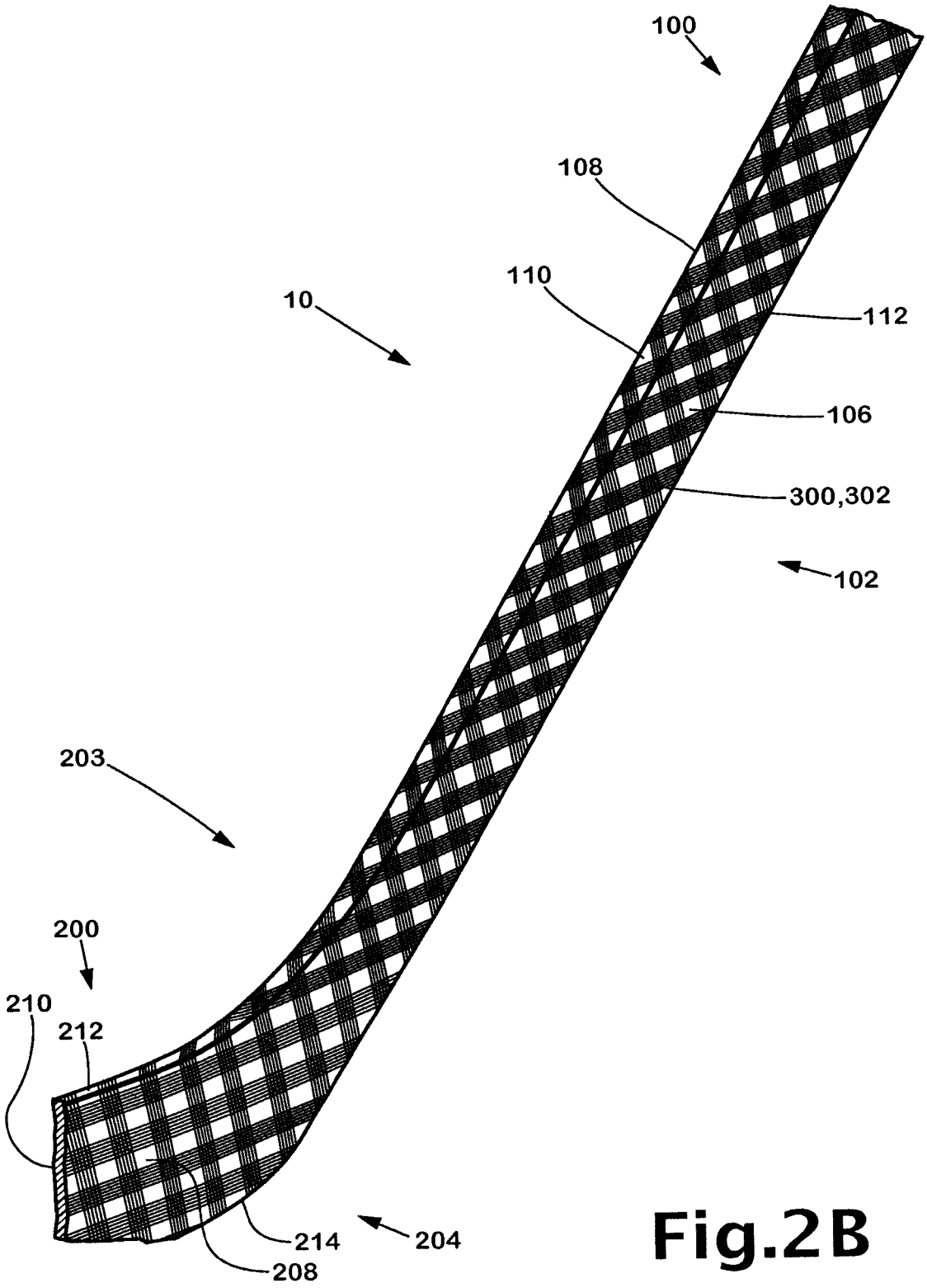
FIG. 2B is a perspective view, taken from a front, top, right side of an enlarged portion of a hockey stick according to another embodiment.
Figure 3:
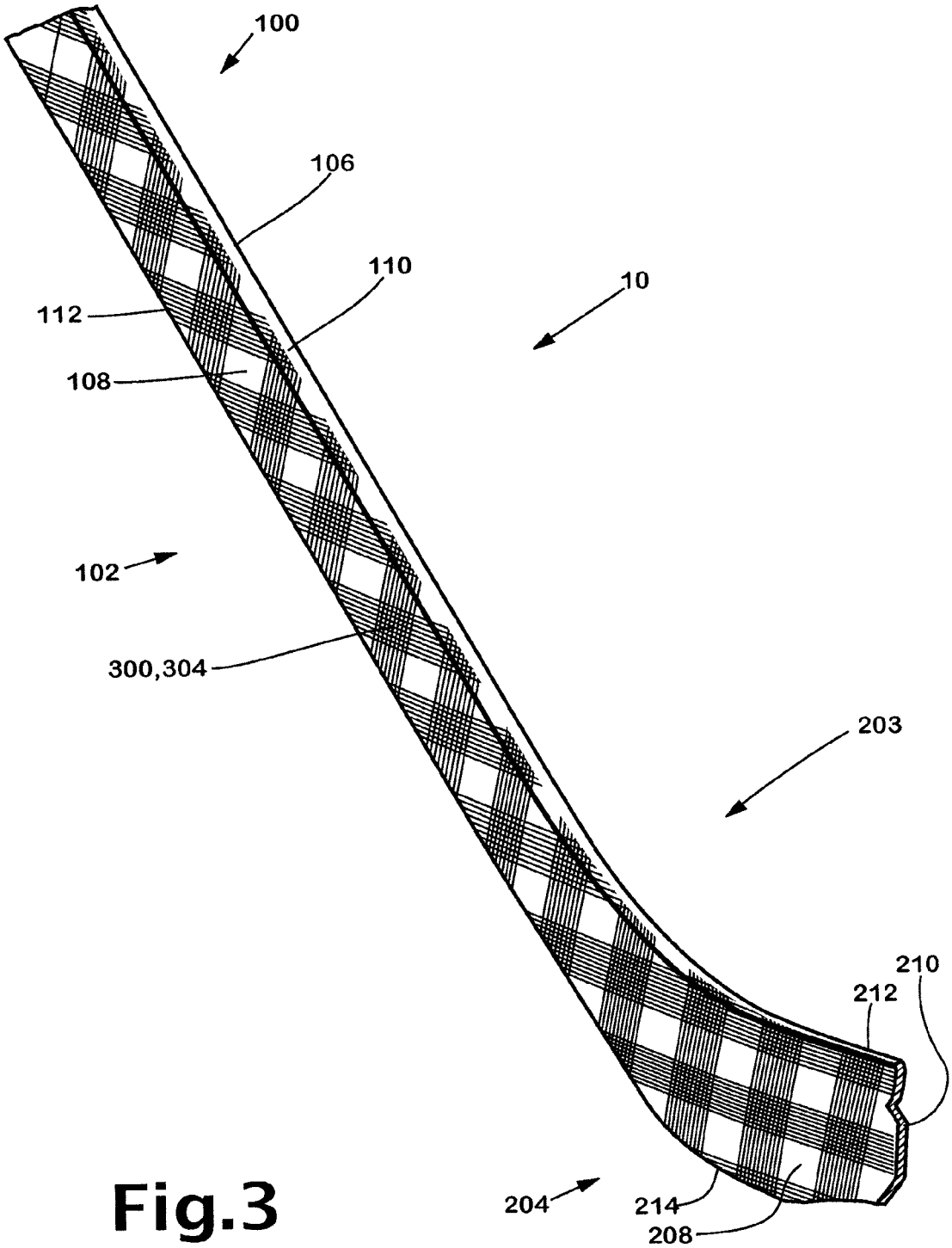
FIG. 3 is a perspective view, taken from a rear, top, left side of the an enlarged portion of hockey stick of FIG. 1.
Figure 4:
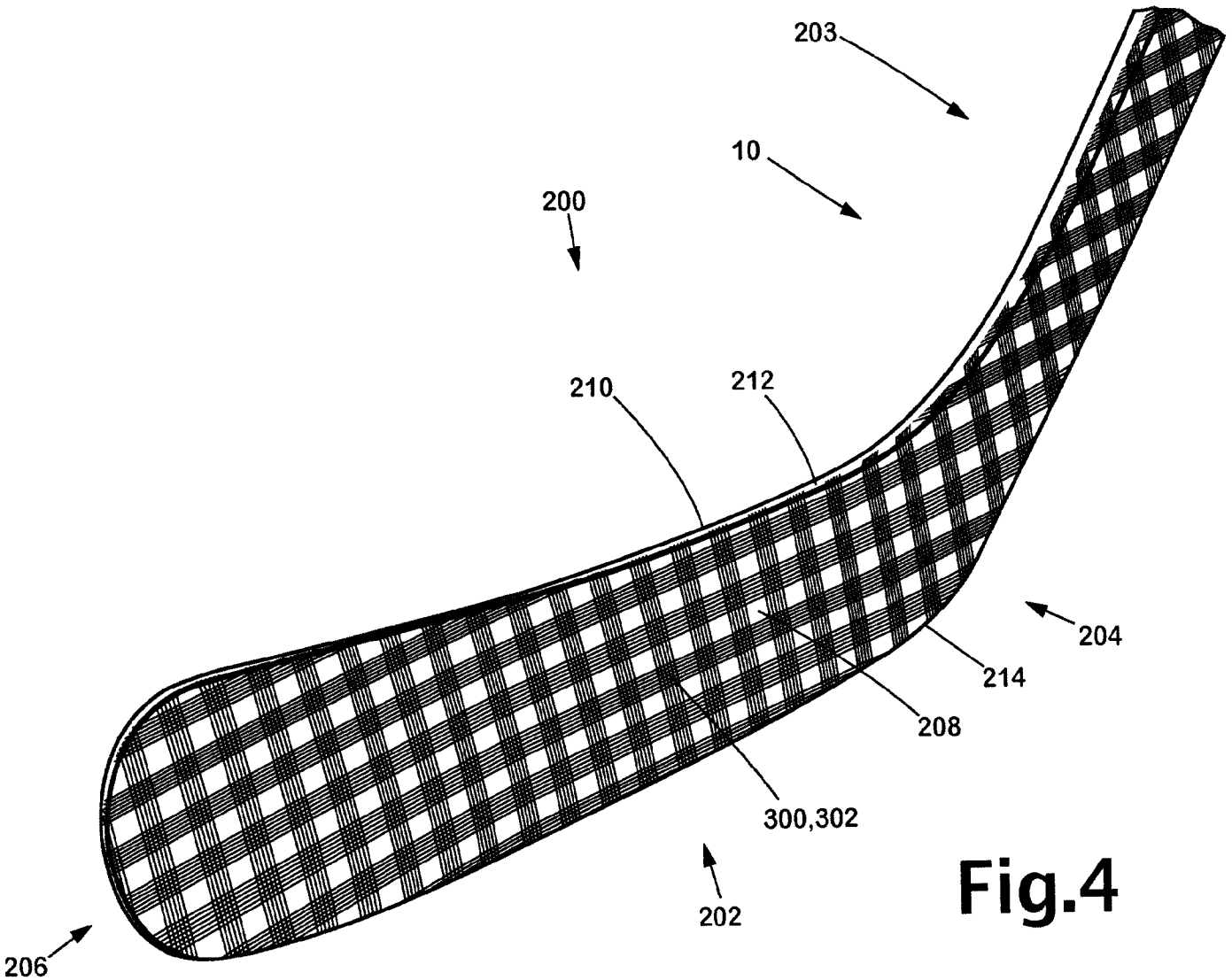
FIG. 4 is a perspective view, taken from a front, top, right side of the an enlarged portion of hockey stick of FIG. 1.
Figure 5:
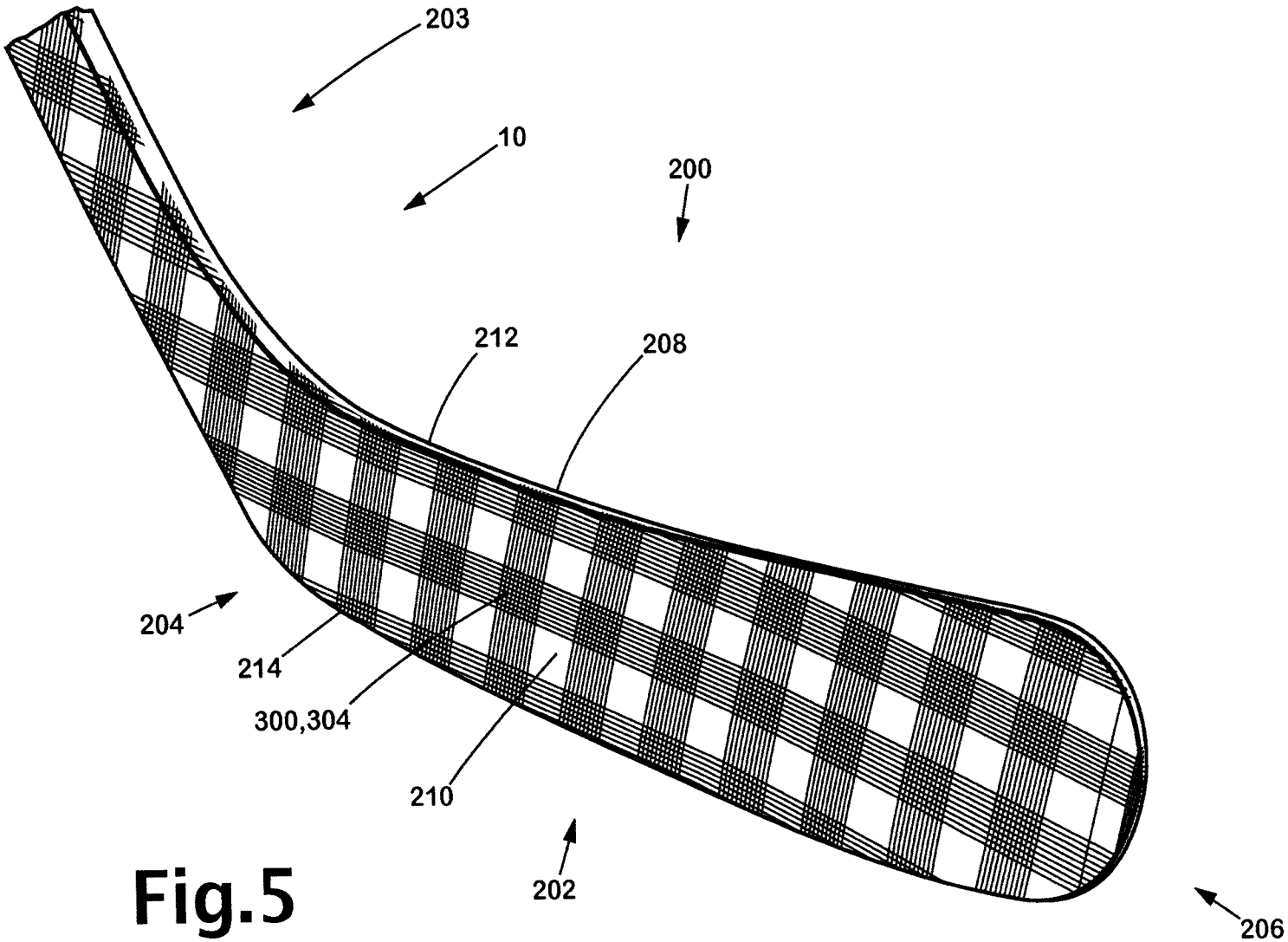
FIG. 5 is a perspective view, taken from a rear, top, right side of an enlarged portion of the hockey stick of FIG. 1.

As shown in FIGS. 1, 2 and 4 the first sheet of carbon fiber reinforced fabric 302 is disposed on the front faces 106, 208 of the shaft 100 and blade 200 and extends until the middle of the top side faces 110, 212 of the shaft 100 and blade 200. As shown in FIGS. 3 and 5, the second sheet of carbon fiber reinforced fabric 304 is disposed on the rear faces 108, 210 of the shaft 100 and blade 200 and extends until the middle of the bottom side faces 112, 214 of the shaft 100 and blade 200.

In this embodiment, the layer of carbon fiber reinforced material 300, i.e. the two sheets of carbon fiber reinforced fabric 302, 304, extends on the whole length of the stick 10, from the toe 206 of the blade 200 to the top end of the distal end 104 of the shaft 100. However, it is contemplated that in other embodiments, the layer of carbon fiber reinforced material 300 may be limited to the blade 200 and not extend past the neck 203 of the blade 200. In yet other embodiments, the layer of carbon fiber reinforced material 300 may extend to a portion of the proximal end 102 of the shaft 100, such as a portion of the proximal end 102 of the shaft 100 that extends to between approximately 30.5 cm and approximately 46.0 cm above the area of the blade 200 where the main blade body 202 meets the heel 204. It is also contemplated that in other embodiments, the layer of carbon fiber reinforced material 300 having the two sheets of carbon fiber reinforced fabric 302, 304 may be limited to the shaft 100 of the hockey stick 10.

It is also contemplated that in other embodiments, the two sheets of carbon fiber reinforced fabric 302, 304 can extend past the middle of the top side faces 110, 212 and bottom side faces 112, 214 of the shaft 100 and blade 200. As an example, in FIG. 213, the first sheet of carbon fiber reinforced fabric 302 extends the whole width of the top side faces 110, 212 of the shaft 100 and blade 200 and it is contemplated that the same thing can be done for the bottom side faces 112, 214 of the shaft 100 and blade 200 (not shown). In such an embodiment, the second sheet of carbon fiber reinforced fabric 304 would only extend until the edges of the rear faces 108, 210 of the shaft 100 and blade 200. An alternative version is also contemplated where the first sheet of carbon fiber reinforced fabric 302 would only be limited to the edges of the front faces 106, 208 of the shaft 100 and blade 200 while the second sheet of carbon fiber reinforced fabric 301 would extend the whole width of the top side faces 110, 212 and bottom side faces 112, 214 of the shaft 100 and blade 200. It is also contemplated that in yet other embodiments (not shown), the two sheets of carbon fiber reinforced fabric 302, 304 can be superposed in whole or in part on the top side faces 110, 212 and bottom side faces 112, 214 of the shaft 100 and blade 200.

As will be further discussed below, the fiber tows 306 of fibers 308 of the first and second sheets of carbon fiber reinforced fabric 302, 304 have different widths and are disposed so that they provide for different densities of fibers 308 on the front faces 106, 208 (referred to as the "first density") and on the rear faces 108, 210 (referred to as the "second density") of the shaft 100 and/or blade 200 (depending on the various possible embodiments), the first density being greater than the second density. It is also contemplated that in other embodiments, the second density could be greater than the first density. It is also contemplated that in other embodiments, the number of fibers 308 comprised in the fiber tows 306 of the first and second sheets of carbon fiber reinforced fabric 302, 304 and the physical properties of such fibers 308 may contribute to having a first and second density that are different notwithstanding the respective widths of the fiber tows 306 of the first and second sheets of carbon fiber reinforced fabric 302, 304 or how they are spaced from each other.

The first density and the second density of fibers 308 can be expressed in various ways including by an average number of fibers 308 per surface unit (e.g., a length and/or area) wherein the first density is greater than the second density when the front faces 106, 208 (first sheet of carbon fiber reinforced fabric 302) contains an average of more fibers 308 for a given surface unit than the rear faces 108, 210 (second sheet of carbon fiber reinforced fabric 304) for the same surface unit. In some embodiments, the first density is greater than the second density when a front face 106, 208 (first sheet of carbon fiber reinforced fabric 302) contains more fibers 308 than a rear face 108, 210 (second sheet of carbon fiber reinforced fabric 304).

Figure 6:
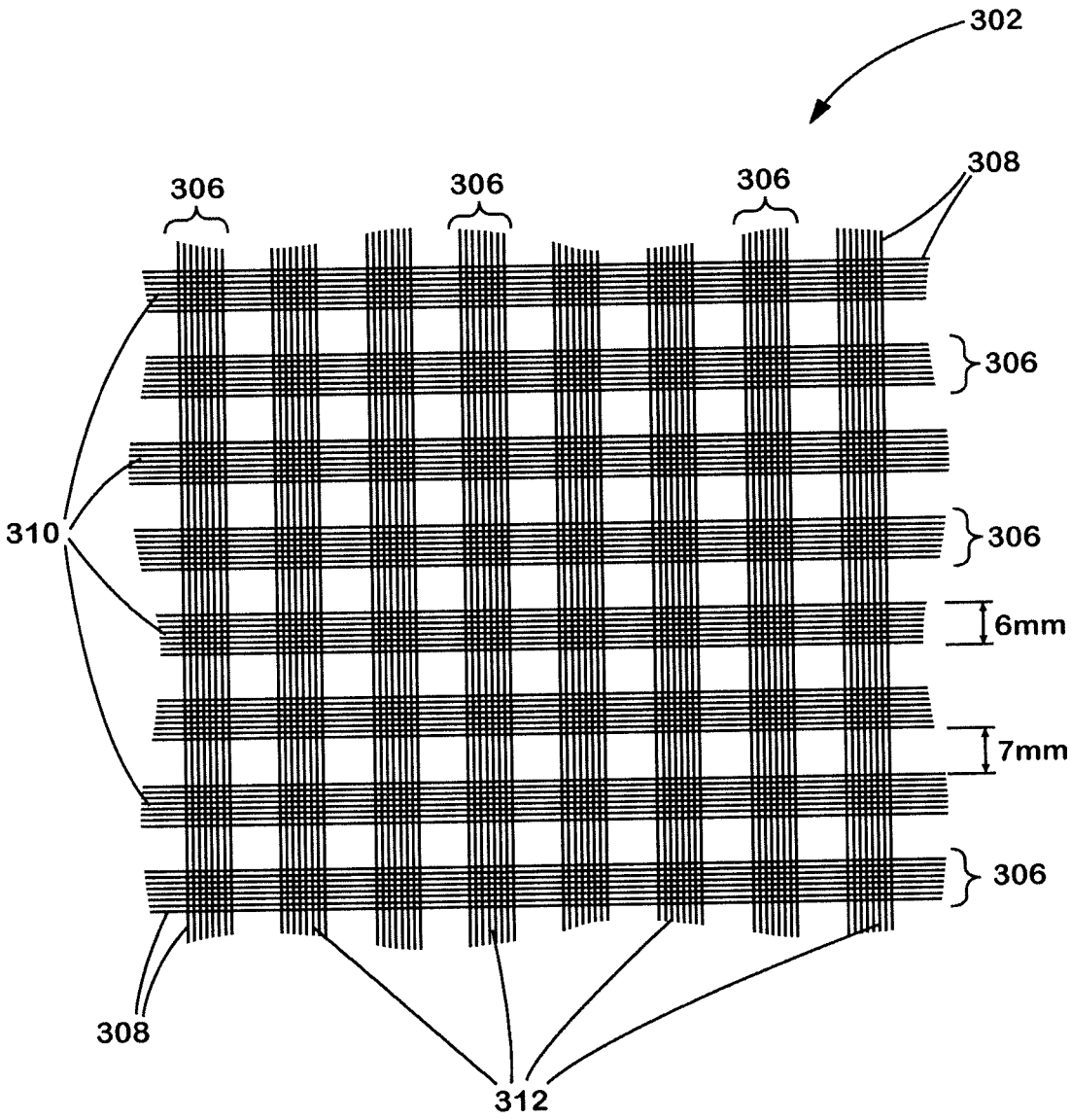
FIG. 6 is a front elevation view of a first sheet of carbon fiber reinforced fabric according to the first embodiment.

As shown in FIG. 6, the fiber tows 306 of fibers 308 of the first sheet of carbon fiber reinforced fabric 302 have a width of approximately 6 millimeters (mm) and they are spaced apart by an approximately 7 mm space. FIG. 6 shows a flat portion of the first sheet of carbon fiber reinforced fabric 302 before it is applied to the stick 10. It is contemplated that once the first sheet of carbon fiber reinforced fabric 302 is applied to the stick 10, the width of the fiber tows 306 and the distance between each of them may vary due to slight deformations of the first sheet of carbon fiber reinforced fabric 302, but the above described proportions between the width of the fiber tows 306 and the space between them roughly stays the same and the first density does not change.

Figure 7:
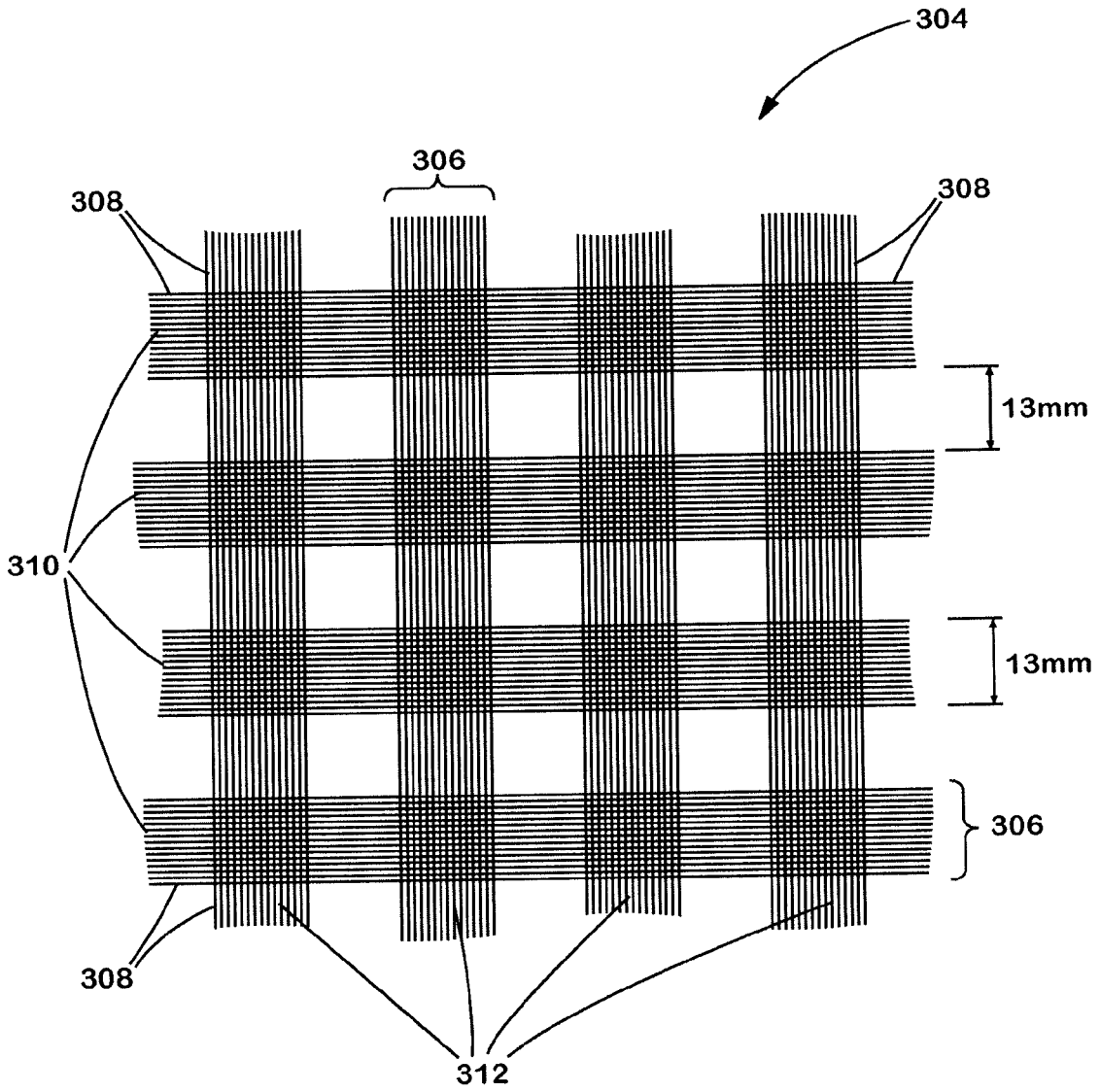
FIG. 7 is a front elevation view of a second sheet of carbon fiber reinforced fabric according to the first embodiment.

As shown in FIG. 7, the fiber tows 306 of fibers 308 of the second sheet of carbon fiber reinforced fabric 304 have a width of 13 mm and they are spaced apart by a 13 mm space. FIG. 7 shows a flat portion of the second sheet of carbon fiber reinforced fabric 304 before it is applied to the stick 10. It is contemplated that once the second sheet of carbon fiber reinforced fabric 304 is applied to the stick 10, the width of the fiber tows 306 and the distance between each of them may vary due to slight deformations of the second sheet of carbon fiber reinforced fabric 304, but the above described proportions between the width of the fiber tows 306 and the space between them roughly stays the same and the second density does not change.

Since, in the embodiment shown in FIGS. 6 and 7 the fiber tows 306 of both the first and second sheet of carbon fiber reinforced fabric 302, 304 comprise the same number of fibers 308, the different widths of the fiber tows 306 contribute to the difference between the first and the second densities, a wider fiber tow 306 having a lower fiber 308 density than a narrower fiber tow 306. In the embodiment shown in FIGS. 6 and 7, the front faces 106, 208 (first sheet of carbon fiber reinforced fabric 302) have an average number of fibers 308 per surface unit (e.g., a length and/or area) that is higher than that of the rear faces 108, 210 (second sheet of carbon fiber reinforced fabric 304). In various embodiments, the number of fibers 308 per surface unit of the front faces 106, 208, may, for example, be at least about 1.25 times, at least about 1.5 times, at least about 2 times, or at least about 2.5 times the average number of fibers 308 per surface unit of the rear faces 108, 210. Stated otherwise, for example, the front faces 106, 208 may have an average of about 400 to about 500 fibers 308 per mm of face width of the front faces 106, 208 while the rear faces 108, 210 would have an average of about 800 to about 1000 fibers 308 per mm of face width of the rear faces 108, 210. In one embodiment, the front faces 106, 208 may have an average of about 800 to about 1000 fibers 308 per $mm^2$ of face width of front faces 106, 208 while the rear faces 108, 210 would have an average of about 1600 to about 2000 fibers 308 per $mm^2$ of face width of rear faces 108, 210.

It is also contemplated that in other embodiments in which the fiber tows 306 of the first and second sheet of carbon fiber reinforced fabric 302, 304 comprise different number of fibers 308, the respective number of fibers 308 comprised in the fiber tows 306 of the first and second sheet of carbon fiber reinforced fabric 302, 304 may also contribute to the difference between the first and the second densities, notwithstanding the respective widths of the fiber tows 306 of the first and second sheets of carbon fiber reinforced fabric 302, 304 or how they are spaced from each other.

Figure 8:
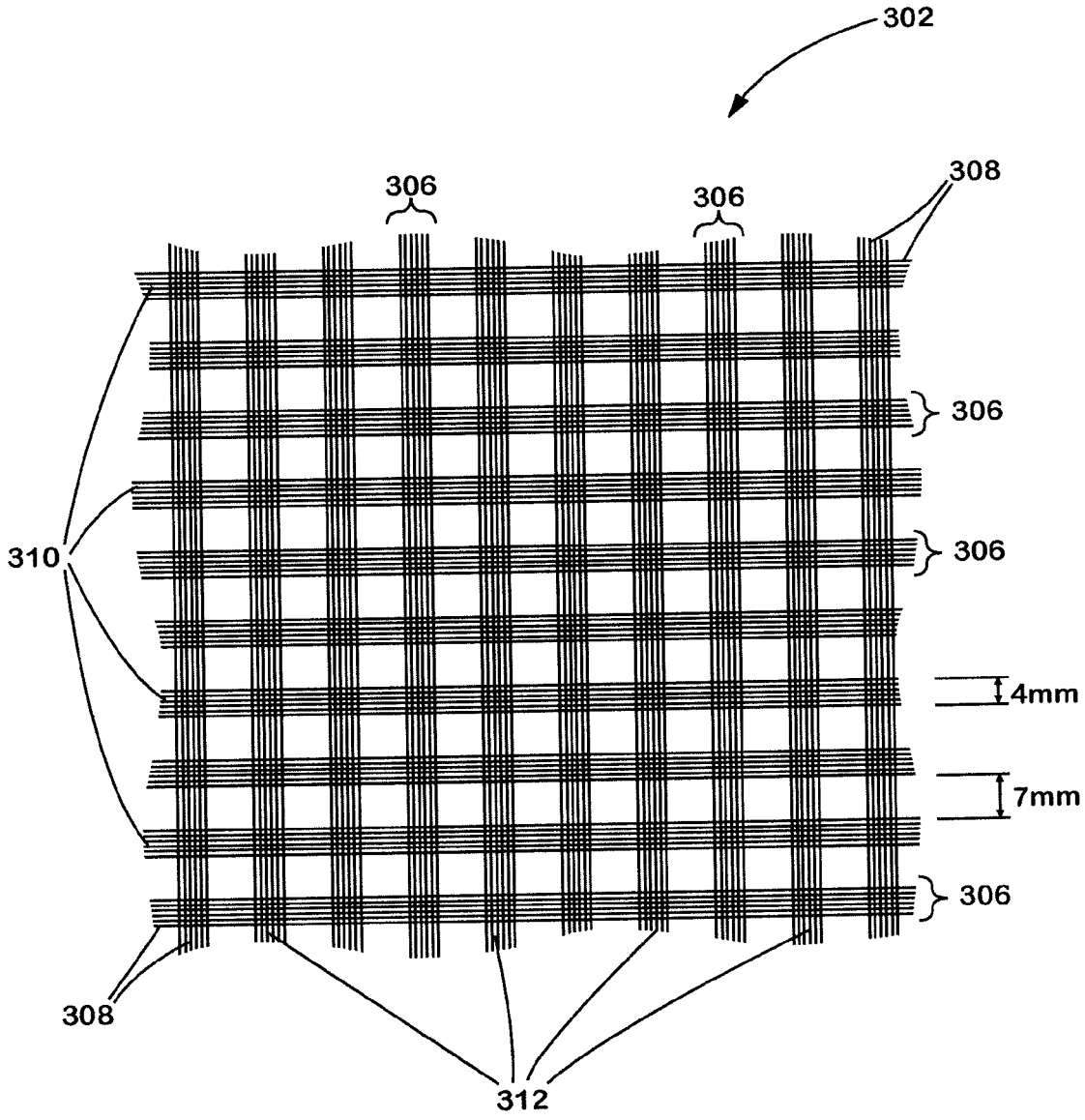
FIG. 8 is a front elevation view of a first sheet of carbon fiber reinforced fabric according to another embodiment.
Figure 9:
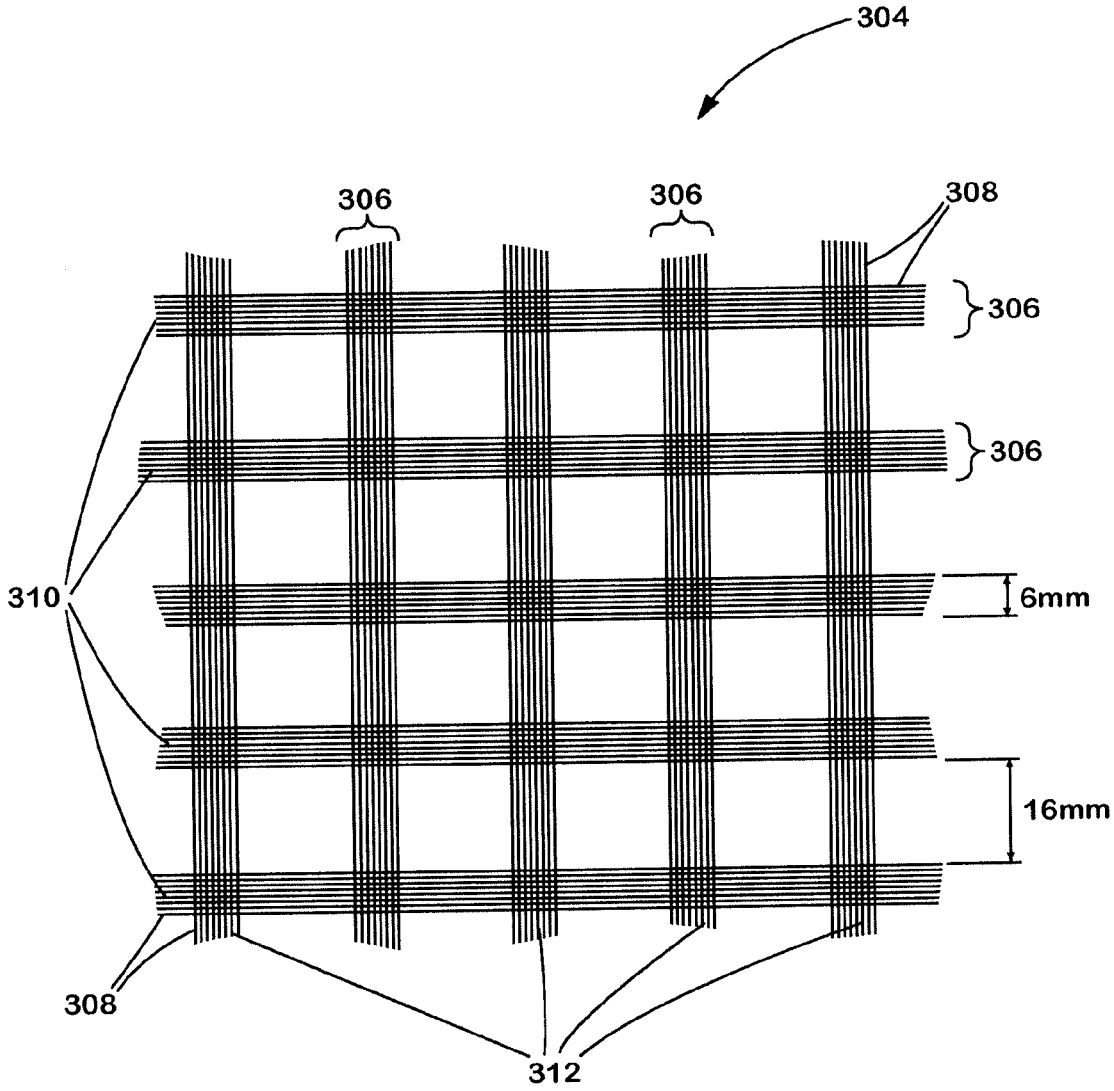
FIG. 9 is a front elevation view of a second sheet of carbon fiber reinforced fabric according to the other embodiment of FIG. 8.

It is contemplated that in other embodiments the width of the fiber tows 306 and the spaces between them may vary on both the first and second sheet of carbon fiber reinforced fabric 302, 304 as long as ratio between the space covered by the fiber tows 306 and the space not covered by the fiber tows 306 is such that the first density is greater than the second density. FIGS. 8 and 9 show such a contemplated embodiment in which the fiber tows 306 of fibers 308 of the first sheet of carbon fiber reinforced fabric 302 (FIG. 8) have a width of approximately 4 mm and are spaced apart by an approximately 7 mm space, while the fiber tows 306 of fibers 308 of the second sheet of carbon fiber reinforced fabric 304 (FIG. 9) have a width of 6 mm and they are spaced apart by a 16 mm space. It is contemplated that in yet other embodiments, the ratio of the width of the fiber tows 306 of the first sheet of carbon fiber reinforced fabric 302 to the width of the fiber tows 306 of the second sheet of carbon fiber reinforced fabric 304 can range from approximately 0.2 to approximately 0.8, such as from approximately 0.3 to approximately 0.6, or from approximately 0.4 to approximately 0.5, while the ratio of the width of the spaces between the fiber tows 306 of the first sheet of carbon fiber reinforced fabric 302 to the width of the spaces between the fiber tows 306 of the second sheet of carbon fiber reinforced fabric 304 can range from approximately 0.2 to approximately 0.8, such as from approximately 0.3 to approximately 0.6, or from approximately 0.5 to approximately 0.6.

It is also contemplated that in other embodiments, the fiber tows 306 may be adjacent or minimally spaced from each other, the first and second densities mainly resulting from the respective widths of the fiber tows 306 of the first and second sheet of carbon fiber reinforced fabric 302, 304, and/or, as the case may be in various embodiments, from the respective number of fibers 308 in the fiber tows 306 of the first and second sheet of carbon fiber reinforced fabric 302, 304 and/or their respective physical properties.

It is also contemplated that in other embodiments (not shown), the fiber tows 306 of fibers 308 can extend differently, i.e. not forming two groups of substantially parallel fiber tows 306 of fibers 308, with each group extending perpendicularly to the other. In some embodiments (not shown), there can be only one group of fiber tows 306 extending either substantially parallel to each other or not. In yet another embodiment (not shown), a second group of fiber tows 306 may extend in a different orientation relative to the fiber tows 306 of a first group of fiber tows 306 so that fiber tows 306 of the second group may cross fiber tows 306 of the first group. In another embodiment, the fibers 308 may be grouped in more than two groups of fiber tows such as fiber tows 306 extending substantially in different directions, or not be grouped in bundles and may extend either substantially parallel to each other or in various directions, according to an organized pattern or not. Finally, it is also contemplated that the fibers 308 may be embedded in more than two sheets of carbon fiber reinforced fabric. For example the two groups 310, 312 of fiber tows 306 of each of the first and second sheets of carbon fiber reinforced fabric 302, 304 could instead be included in different sheets (i.e. one group 310 or 312 of fiber tows 306 per sheet).

In the various contemplated embodiments discussed above, the first density (i.e. the ratio between the space covered by fibers 308 and the space not covered by fibers 308 in the first sheet of carbon fiber reinforced fabric 302) is greater than the second density (i.e. the ratio between the space covered by fibers 308 and the space not covered by fibers 308 in the second sheet of carbon fiber reinforced fabric 304). As examples, it is contemplated that the ratio of the area covered by fibers 304 on the first sheet of carbon fiber reinforced fabric 302 to the area covered by fibers 308 on the second sheet of carbon fiber reinforced fabric 304 could range front approximately 0.7 to approximately 1.2, such as from approximately 0.8 to approximately 1.1, or from approximately 0.9 to approximately 1.

It is also contemplated that the first and second densities can be established by converting the ratios discussed above in term of percentages. As an example, it is contemplated that the area of the first sheet of carbon fiber reinforced fabric 302 covered by fibers 308 is approximately 1% to approximately 10% smaller than the area of the second sheet of carbon fiber reinforced fabric 301 covered by fibers 308, such as approximately 3% to approximately 6% smaller.

A method of making a hockey stick 10 and/or and blade 200 is also contemplated, such method including the step of providing the core of the stick 10 or blade 200 and applying thereto the first and second sheets of carbon fiber reinforced fabric 302, 304 to the front faces 106, 208 and the rear faces 108, 210 respectively of the shaft 100 and/or blade 200 as the case may be.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A hockey stick blade comprising:

a front blade face, a rear blade face, a heel and a neck, the front blade face comprising at least one front layer of reinforcing fiber material, the at least one front layer having a first reinforcing fiber density, the at least one front layer having reinforcing fibers arranged in at least one front face reinforcing fiber pattern comprising a plurality of front face fiber tows of reinforcing fibers, the plurality of front face fiber tows having a first tow width and being spaced apart from each other by a first distance, the first tow width and the first distance contributing to the first reinforcing fiber density, the rear blade face comprising at least one rear layer of reinforcing fiber material, the at least one rear layer having a second reinforcing fiber density, the at least one rear layer having reinforcing fibers arranged in at least one rear face reinforcing fiber material pattern comprising a plurality of rear face fiber tows of reinforcing fibers, the plurality of rear face fiber tows having a second tow width and being spaced apart from each other by a second distance, the second tow width and the second distance contributing to the second reinforcing fiber density, and wherein the first reinforcing fiber density differs from the second reinforcing fiber density.

2. The hockey stick blade of claim 1, wherein:

the first reinforcing fiber density is greater than the second reinforcing fiber density.

3. The hockey stick blade of claim 1, wherein:

the plurality of front face fiber tows have a different number of fibers per unit width than the plurality of rear face fiber tows.

4. The hockey stick blade of claim 3, wherein:

the first reinforcing fiber density is greater than the second reinforcing fiber density.

5. The hockey stick blade of claim 3, wherein:

the plurality of front face fiber tows each contain about the same number of fibers as the plurality of rear face fiber tows; and the first tow width differs from the second tow width, whereby the plurality of front face fiber tows have a different number of fibers per unit width than the plurality of rear face fiber tows.

6. The hockey stick blade of claim 1, wherein:

the front face fiber tows form a first front group of similarly aligned front face fiber tows, and the at least one front face reinforcing fiber pattern further comprises a second front group of similarly aligned front face fiber tows of reinforcing fibers, the front face fiber tows of the second front group having a tow width similar to the first tow width, and being spaced apart from each other by a distance similar to the first distance, the first front group extending at an angle relative to the second front group; and the rear face fiber tows form a first rear group of similarly aligned rear face fiber tows, and the at least one rear face reinforcing fiber pattern further comprises a second rear group of similarly aligned rear face fiber tows of reinforcing fibers, the rear face fiber tows of the second rear group having a tow width similar to the second tow width, and being spaced apart from each other by a distance similar to the second distance, the first rear group extending at an angle relative to the second rear group.

7. The hockey stick blade of claim 6, wherein:

the front face fiber tows of the first front group extend generally parallel to each other, and the front face fiber tows of the second front group extend generally parallel to each other; and the rear face fiber tows of the first rear group extend generally parallel to each other, and the rear face fiber tows of the second rear group extend generally parallel to each other.

8. The hockey stick blade of claim 7, wherein:

the front face fiber tows of the first front group extend substantially perpendicularly to the front face fiber tows of the second front group; and the rear face fiber tows of the first rear group extend substantially perpendicularly to the rear face fiber tows of the second rear group.

9. The hockey stick blade of claim 1, wherein:

a portion of the front blade face covered by reinforcing fibers arranged in the at least one front reinforcing fiber pattern is approximately 1% to approximately 10% greater than a portion of the rear blade face covered by reinforcing fibers arranged in the at least one rear reinforcing fiber pattern.

10. The hockey stick blade of claim 6, wherein:

a ratio of the first tow width to the second tow width is approximately 0.2 to approximately 0.8.

11. The hockey stick blade of claim 6, wherein:

a ratio of the first distance to the second distance is approximately 0.2 to approximately 0.8.

12. The hockey stick blade of claim 6, wherein:

an area of the front blade face covered by the first and second front groups is a first covered area;

an area of the rear blade face covered by the first and second rear groups is a second covered area; and a ratio of the first covered area to the second covered area is approximately 0.8 to approximately 1.1.

13. The hockey stick blade of claim 1, wherein the blade is integral with a hockey stick shaft.

14. The hockey stick blade of claim 1, wherein:

the plurality of front face fiber tows is greater in number than the plurality of rear face fiber tows.

15. The hockey stick blade of claim 14, wherein:

each tow of the plurality of front face fiber tows has about the same number of reinforcing fibers as each tow of the plurality of rear face fiber tows.

16. The hockey stick blade of claim 1, wherein the reinforcing fiber material comprises carbon fibers.

17. The hockey stick blade of claim 16, wherein the reinforcing fiber material is a carbon-fiber-reinforced polymer.

18. A hockey stick comprising:

a shaft having a proximal end and a distal end opposite the proximal end, a front face and a rear face; and a blade connected to the shaft, the blade having a front blade face, a rear blade face, a heel and a neck adjacent the proximal end of the shaft, the front blade face comprising at least one front layer of reinforcing fiber material, the at least one front layer having a first reinforcing fiber density, the at least one front layer having reinforcing fibers arranged in at least one front face reinforcing fiber pattern comprising a plurality of front face fiber tows of reinforcing fibers, the plurality of front face fiber tows having a first tow width and being spaced apart from each other by a first distance, the first tow width and the first distance contributing to the first reinforcing fiber density, the rear blade face comprising at least one rear layer of reinforcing fiber material, the at least one rear layer having a second reinforcing fiber density, the at least one rear layer having reinforcing fibers arranged in at least one rear face reinforcing fiber material pattern comprising a plurality of rear face fiber tows of reinforcing fibers, the plurality of rear face fiber tows having a second tow width and being spaced apart from each other by a second distance, the second tow width and the second distance contributing to the second reinforcing fiber density, and wherein the first reinforcing fiber density differs from the second reinforcing fiber density.

19. The hockey stick of claim 18 wherein the hockey stick is a one piece hockey stick.

20. The hockey stick of claim 18, wherein:

the at least one front layer of reinforcing fiber material extends along at least a portion of the front face of the proximal end of the shaft; and the at least one rear layer of reinforcing fiber material extends along at least a portion of the rear face of the proximal end of the shaft.

21. The hockey stick of claim 18, wherein:

the at least one front layer of reinforcing fiber material extends along the front face of the shaft; and the at least one rear layer of reinforcing fiber material extends along the rear face of the shaft.

22. The hockey stick of claim 18, wherein:

the first reinforcing fiber density is greater than the second reinforcing fiber density.

23. The hockey stick of claim 18, wherein:

the plurality of front face fiber tows have a different number of fibers per unit width than the plurality of rear face fiber tows.

* * * * *